United States Patent [19]

Yazawa et al.

[11] 4,211,807

[45] Jul. 8, 1980

[54] REINFORCED NON-WOVEN FABRICS AND METHOD OF MAKING SAME

[75] Inventors: Masahide Yazawa; Kazuhiko Kurihara, both of Tokyo, Japan

[73] Assignees: Polymer Processing Research Institute Ltd.; Sekisui Kagaku Kogyo Kabushiki Kaisha, both of Tokyo, Japan

[21] Appl. No.: 906,004

[22] Filed: May 15, 1978

Related U.S. Application Data

[63] Continuation of Ser. No. 603,206, Aug. 8, 1975, abandoned.

[51] Int. Cl.[2] ..... B32B 5/10; D04H 1/62; D04H 1/74

[52] U.S. Cl. ..... 428/109; 156/177; 156/178; 156/291; 156/296; 156/309.6; 264/109; 428/114; 428/255; 428/284; 428/290

[58] Field of Search ..... 156/176, 174, 175, 177, 156/178, 179, 181, 279, 285, 62.2, 309, 290, 206, 296, 155, 166, 168, 167; 428/248, 255, 282, 284, 246, 247, 198, 107, 108, 109, 257, 258, 280, 288, 289, 295, 195, 196, 259, 211, 114, 290

[56] References Cited

U.S. PATENT DOCUMENTS

| | | | |
|---|---|---|---|
| 1,269,140 | 6/1918 | Wheildon | 156/161 |
| 2,797,728 | 7/1957 | Slayter et al. | 156/175 |
| 2,902,395 | 9/1959 | Hirschy et al. | 428/255 |
| 3,047,444 | 7/1962 | Harwood | 264/128 |
| 3,709,764 | 1/1973 | Thomas | 156/279 |
| 3,762,984 | 10/1973 | Goldbeck | 428/198 |
| 3,855,036 | 12/1974 | Solbeck | 156/181 |
| 3,917,889 | 11/1975 | Gaffney et al. | 264/DIG. 81 |

*Primary Examiner*—Michael W. Ball
*Attorney, Agent, or Firm*—Fred Philpitt

[57] ABSTRACT

A non-woven product of (1) a fleece layer with (2) sticking yarns arranged longitudinally in parallel at definite pitches and (3) a number of lines formed with short fibers of the fleece layer joined with filaments of an adhesive polymer adhering crosswise to the sticking yarns at parts where said filaments have been allocated on the surface of said fleece layer, is prepared by placing the fleece layer upon a warp layer composed of a number of yarns arranged flat in parallel at definite pitches into a definite width whose arrangement is fixed by laterally adhering a number of filaments of the adhesive polymer to said yarns and making the warp layer adhere to the fleece layer.

Another type of non-woven product of a fleece layer is prepared by adhering cut sheets of another warp layer having the structure similar to the above-mentioned side by side without leaving any gaps between each other as wefts to the fleece layer surface of the non-woven product prepared as above-mentioned in a manner so as to sandwich the fleece layer between sticking yarns arranged longitudinally and in parallel and sticking yarns arranged laterally and in parallel.

A fleece layer is placed upon a warp layer by filtering a fluid bearing numberless short fibers floating therein, through said warp layer as a filter medium, while running said warp layer over a stationary suction zone provided under the running warp layer.

4 Claims, 13 Drawing Figures

FIG. 1
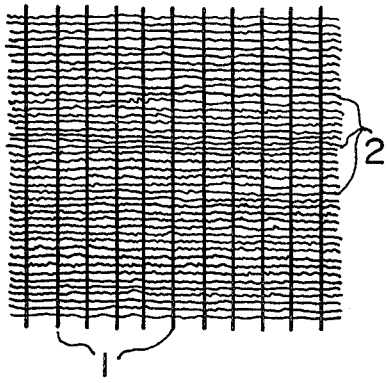
FIG. 2
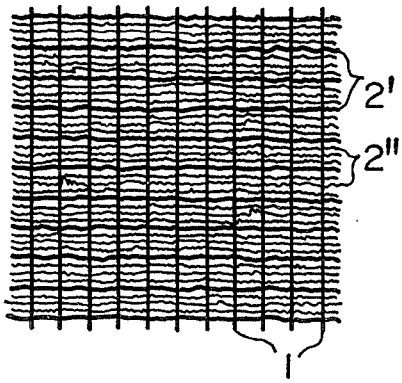
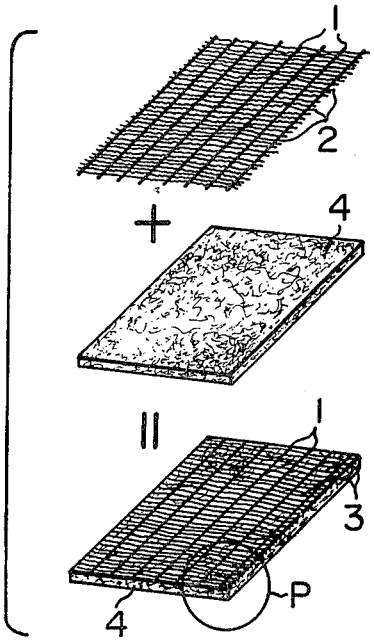
FIG. 3a
FIG. 3b
FIG. 3c
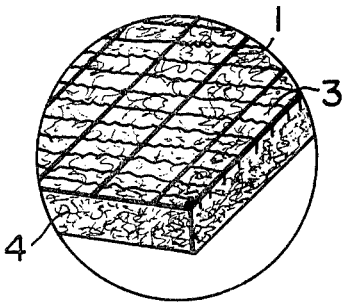
FIG. 3d

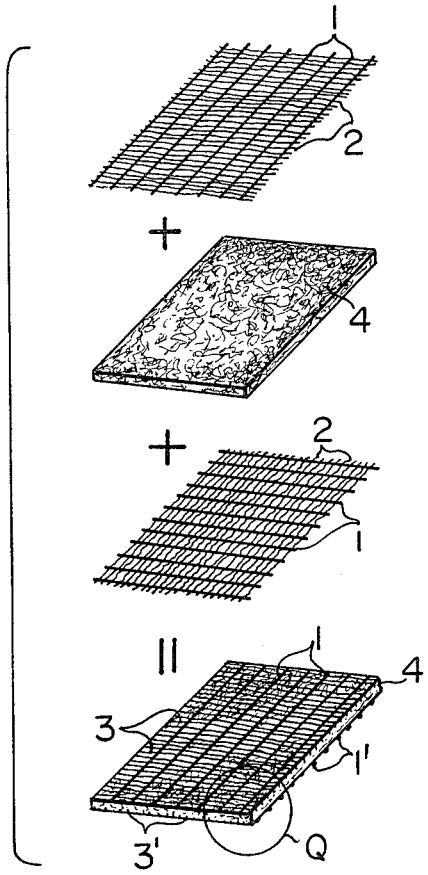
FIG. 4a
FIG. 4b
FIG. 4c
FIG. 4d
FIG. 4e
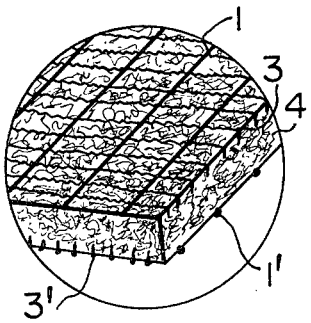
FIG. 4f
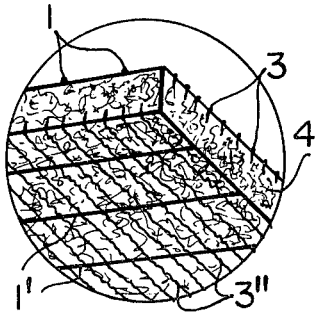
FIG. 5
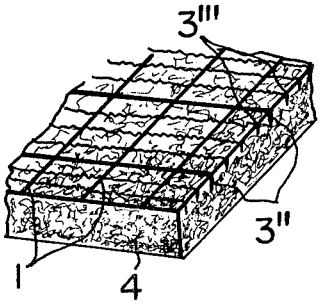

REINFORCED NON-WOVEN FABRICS AND METHOD OF MAKING SAME

This is a continuation of application Ser. No. 603,206, filed Aug. 8, 1975, now abandoned.

DESCRIPTION OF THE INVENTION

The present invention relates to a method for preparing a new kind of non-woven product composed of (1) a fleece layer with layer(s) of sticking yarns arranged in parallel and (2) a number of lines formed with short fibers of the fleece layer joined with filaments of an adhesive polymer adhering crosswise to said yarns. The object of the present invention is, on one hand, to provide valuable fibrous products having wide application fields by utilizing cheap waste fibers from spinning mills, reclaimed fibers and staple or cut fibers together with less amount of yarns as compared with woven textiles of the same density, resulting in saving natural resources and man power and, on the other hand, to provide very thin but strong and dimensionally stable products from chopped strands of glass fiber robing together with glass fiber yarns as stated later in details.

The products according to the method of the present invention are divided into two groups; the one which has layer(s) of a number of sticking yarns arranged longitudinally in parallel without slacking to the surface of a fleece layer and a number of lines formed with fibers of the fleece layer joined with filaments of an adhesive polymer adhering crosswise to said yarns and the other which has a fleece layer sandwiched between a sticking layer of parallel yarns arranged longitudinally and a sticking layer of parallel yarns arranged laterally together with lines of connected short fibers of the fleece layer adhering crosswise to the yarns on each of the surfaces thereof.

More particularly, the method comprises placing a fleece layer upon a warp layer composed of a number of yarns arranged flat in parallel and at definite pitches into a width corresponding to that of the desired non-woven product, arrangement of which yarns has been fixed by a number of filaments of an adhesive polymer (these filaments of an adhesive polymer, hereinunder, are simply denoted as "adhesive filaments") adhering to one of the surface thereof and laterally connecting the yarn one by one with said adhesive filaments (the hereinbefore stated layer is merely denoted as a "warp layer"), while running both of the layers longitudinally; and making the warp layer adhere to the fleece layer; whereby the fleece layer is reinforced longitudinally by parallel yarns sticking thereto as well as laterally by a number of cooperating lines of short fibers of the fleece layer joined together by adhesive filaments adhering crosswise to said yarns at parts where the filaments have been allocated. This is one feature of the present invention and the product is denoted as "non-woven product reinforced longitudinally" for simplicity.

Another feature of the present invention lies in a method for placing a fleece layer upon a warp layer. As the warp layer composed of warp yarns and adhesive filaments of wefts, can be used as a filter medium for picking up short fibers, the short fibers are uniformly picked up as a fleece layer on said warp layer by filtering through said warp layer a fluid bearing numberless said short fibers, supplied from a device which makes said short fibers float in said fluid, while running the warp layer as a filter medium over a stationary suction zone provided under the warp layer to effect a negative pressure from the backside thereof at the time of filtering.

The further feature of the present invention relates to a method for preparing another type of a non-woven product composed of a fleece layer and sticking yarns arranged in parallel at definite pitches on both the surfaces of said fleece layer but longitudinally on one surface and laterally on the other surface in sandwiching manner wherein a number of lines are formed by short fibers of the fleece layer joined together with adhesive filaments adhering crosswise to said yarns at parts where said filaments have been allocated on each surface of said fleece layer. The product is denoted as "non-woven product reinforced crosswise" for simplicity.

The method for preparing the non-woven product of the present invention also comprises placing, upon one surface of a fleece layer opposite to the surface, to which a warp layer has already been stuck longitudinally, placing crosswise cut sheets of another warp layer of a similar structure and of a length corresponding to the width of the already reinforced fleece layer, one by one as wefts without leaving any gaps between each other and making the cut sheets adhere to the surface of the fleece layer, whereby the fleece layer is reinforced by sandwiching between the longitudinally arranged parallel sticking yarns on one surface thereof and the laterally arranged parallel sticking yarns on the other surface thereof and also by a number of cooperating lines of short fibers of the fleece layer joined together with adhesive filaments adhering crosswise to the sticking yarns at parts where said filament have been allocated on each surface of the fleece layer.

In the present invention, "a fleece layer" includes a layer of random web composed of short fibers selected from the group consisting of paper and non-woven fabric available from market, each one of which is an aggregated layer of short fibers; layers of staple or cut fibers of natural and artificial origins; layers of waste fibers from spinning mills; layers of asbestas short fibers; layers of short fibers incapable of spinning and containing some quantity of comparatively long fibers, such as thin layers of reclaimed fibers, glass-wool and rock- or slag-wool; and layers of mixed fibers of above-mentioned, irrespective of their length. The fleece layer further includes such sheets as those prepared by crookedly intertwining melt-spun filaments which intersect each other and are joined together at numerous points of contact, leaving irregular distances comparable to the length of short fibers above-mentioned, between each other along the entire length of each of the crooked filaments.

And "yarns" referred to in the present invention are those selected from the group consisting of mutually independent linear stocks available from markets, such as spun yarns, multifilament yarns, monofilaments, stretched tapes (flat yarns or ribbon yarns) and split-fiber yarns of reticulated structure.

The most remarkable feature in common with the non-woven product, whether reinforced longitudinally or crosswise, prepared according to the method of the present invention is that the products are combinations of a warp layer and a fleece layer as explained in details later in a manner where the fleece layer is reinforced by making parallel yarns of the warp layer stick to the surface thereof, and also making a number of cooperating lines of short fibers of the fleece layer joined together with adhesive filaments adhering crosswise to the sticking yarns at parts where said filaments have been allocated on said surface of the fleece layer. The functions of said co-operating lines are explained later in details at places in the specification of the present invention. The product reinforced crosswise by sandwiching a fleece layer between warp and weft yarns together with said reinforcing lines has never been known till now and the present invention proposes the method for preparing a new kind of non-woven products having such cooperating lines besides sticking parallel yarns reinforcing in both crosswise and longitudinal direction by applying warp layers preferably prepared according to a method of a prior invention of the present inventor and his co-inventor cited in the following description.

The present invention discloses methods for utilizing warp layers prepared according to the method of said prior invention, which method comprises running a number of elongated stocks cylindrically arranged at definite pitches; ejecting a polymer liquid supplied into a high speed rotating vessel of discus shape provided at a central part of said cylindrically arranged elongated stocks, in a form of a number of fibers which are long enough to be said "filaments" in other words through orifices furnished on the outer periphery of the vessel, onto said elongated stocks by a centrifugal force, so as to be made adhere the resulting filaments of the polymer liquid in parallel arrangement and in the lateral direction onto the inner side of the cylindrically arranged stocks, running outside and laterally connecting the elongated stocks one another at definite pitches, then flattening the entire stocks, while cutting open and withdrawing the flattened stocks.

Namely, the present invention opens a valuable application field of the products prepared according to the method of the prior invention as a new kind of non-woven products reinforced longitudinally or crosswise by combining the above-mentioned stocks with fleece layers.

According to the method of the present invention, such fleece layers as those of waste fibers from spinning mills or reclaimed fibers which are hitherto comparatively of little value as raw material for industrial purposes except for the cases used as waddings, etc., are combined with said flattened stocks of the prior invention, that is, warp layers to turn into valuable products which are strong and yet pliable and air-permeable and also when a fleece layer of cut short fiber glass is combined with a warp layer of glass fiber yarns prepared according to the method of the prior invention, a novel very thin but dimensionally stable and strong non-woven product which is non-combustible, can be produced.

A non-woven product reinforced longitudinally is valuable, when a high strength is necessary only in longitudinal direction but not so high a strength in the lateral direction and the product whose fleece layer is composed of waste fibers is not only bulky, pliable and air-permeable but also has improved resistance against degradation which is liable to occur when wetted with water. These are some of the advantageous points of the product of the present invention and the present inventor finds that there are many other application field where the non-woven product of this type can be used as explained later.

Another type of non-woven products of the present invention is the product reinforced crosswise which has good dimension stability and high strength in both of the longitudinal and lateral directions and moreover has high seam strength when sewn up. Bags made of this type of non-woven products are not slippery due to the effects of not only lines composed of the short fibers of the fleece layer joined together by adhesive filaments at parts where said filaments are allocated on, but also yarns sticking to the exposed surface thereof.

A noteworthy property to be mentioned especially about a non-woven product reinforced crosswise is that, when this product is subjected to a concentrated load on one point on the product, the stress caused by the load propergates in all directions not only along the yarns sticking to both the surface of the product, but also along short fibers of the fleece layer combined therewith and forming a number of lines composed of short fibers thereof by adhesive filaments adhering crosswise to the yarns and bonded firmly to the yarn at numerous places where said filaments have been allocated. In the case of a loosely woven textile of the yarns of the same density as that of the product of the present invention, however, the stress due to the load propergates only along the yarns. That is, the non-woven product reinforced crosswise is more tenacious than woven products and can serve to save expensive yarns by replacing them with cheap short fibers of a fleece layer which cooperate with less amount of yarns and adhesive filaments to keep the same strength as that of woven products.

This type of non-woven products reinforced crosswise is conveniently prepared by; placing a fleece layer upon a warp layer, while allowing both the layers to run in the longitudinal direction thereof and making the fleece layer adhere to the warp layer; upon one surface of the fleece layer opposite to the surface to which the warp layer has already been made adhered, placing crosswise cut sheets of the other warp layer of the same structure and of a length corresponding to the width of the above-mentioned fleece layer one by one as wefts without forming any gaps between each other; and making cut sheets adhere to the fleece layer according to the modified method of U.S. Pat. Nos. 3,669,795 issued June 13, 1972, 3,853,662 issued Dec. 10, 1974 and 3,859,156 issued Jan. 7, 1975 to the present inventor and his co-inventors.

Another method for overlaying individual cut sheets of a warp layer crosswise one by one as wefts upon the surface of fleece layer, opposite to which surface another warp layer has been stuck longitudinally, is to overlay an elongated weft layer upon the surface of the fleece layer, making both the elongated weft layer and the warp layer having the fleece layer thereon to run longitudinally. Said elongated weft layer is prepared in advance by placing individual cut sheets of a warp layer for wefts side by side in a row so that each yarn of said cut sheets is arranged perpendicularly to the longitudinal direction of the elongated weft layer and joining both of the front and rear cut end parts of said individual cut sheets with the respective selvedge materials, which are furnished to the positions decided to become the right and left selvedges of the layer to be prepared, without forming any gaps between each other.

An elongated weft layer above-mentioned is denoted as "weft layer" for simplicity. The selvedge material is an elongated material, which is to form one selvedge of the weft layer to be prepared together with attached cut end parts of the yarns of the cut sheets and conveniently selected from the group consisting of yarns thereinbefore defined, narrow tapes of paper, film, thin cloth tapes and knitted tapes, irrespective of their thickness, number of ends and also kinds or origins of their raw materials, according to the required conditions of the products.

For instance, there are cases where a weft layer composed of spun yarns of regenerated cellulose staple fibers and a selvedge material composed of one end of flat yarns of high density polyethylene on each selvedge of the layer and another weft layer composed of glass fiber yarns and a selvedge material composed of several ends of the same glass fiber yarns on each selvedge of the layer and so on.

In case of preparing a weft layer, especially having a wide width, there may be cases where it is necessary to make a number of additional yarns, especially thin ones, conveniently selected from the group thereinbefore stated according to the required conditions of the product to be prepared, adhere to the weft layer in parallel at 50–300 mm pitches between both of the selvedge materials thereof at the time of preparation, because of easy handling, and necessities in preventing the selvedge of the cut sheets contacting with successive ones from becoming disordered and moreover in preventing the yarns of the weft layer from being stripped off or becoming disordered at the time of successive lamination. And said number of additional yarns and adhering pitch thereof are determined mainly according to the necessity in preventing the yarns constituting the weft layer from being stripped off at the time of successive lamination.

Combination, procedures or laminating manners of fleece layers with warp layers, regardless of whether the sticking yarns of the product are directed longitudinally or crosswise, are selected mainly depending upon the properties required for specific usages, or the properties of raw materials used for the warp layers and fleece layers. There are, for instance, a combination in which two fleece layers sandwich a warp layer, another combination in which two warp layers sandwich a fleece layer and a further combination in which fleece layers and warp layers are piled up alternately or vice versa.

In all of those combinations as mentioned above, both of the adhesive filaments and the yarns, which are sticking to the fleece layer firmly, serve to catch fluffs on the surface of the fleece layer, resulting in preventing the exposed surface of the fleece layer from becoming fluffy, even when rubbed and also to give non-slippery nature to the surface.

As for preparing warp layer, there are many processes for adhering adhesive filaments to one surface of yarns arranged in parallel at definite pitches. Among them, there is a process comprising adhering melt-spun filaments of an adhesive polymer immediately after melt-spun to one surface of a web composed of a number of yarns arranged flat in parallel and at definite pitches into a definite width, namely, a process comprising, onto a running web of yarns arranged in the above-mentioned order, adhering a number of melt-spun filaments of an adhesive polymer in zig-zag manner across the whole width of said web immediately after leaving spinning nozzles. However, a warp layer can preferably be prepared at high speed by the method of the prior invention explained thereinbefore and warp layers obtained according to this method are the most preferable for the preparation of non-woven products of the present invention.

Next, descriptions about adhesive polymers applicable to the present invention are given. Generally, thermoplastic polymers of linear structure have fiber forming property and are preferably applied to the present invention. Upon being ejected centrifugally through orifices provided on the outer periphery of a high speed rotating vessel of discus shape, those thermoplastic polymers turn into filaments which are going to adhere to the cylindrically arranged yarns running outside. The higher the rotating speed is, the stronger the tenacity of the filaments is, owing to the fact that the molecular orientation of the filaments is improved at a rate approximately proportional to the rotating speed of said vessel, according to the well-known effect of high speed melt-spinning. The ejected filaments, however, must be so made as to reach the inside surface of the cylindrically arranged yarns, while the ejected filaments are still hot and have adhering ability thereto for preparing a warp layer. Adhering ability of filaments, however, varies according to the kind of polymer applied, molecular weight and molecular weight distribution of the polymer, and temperature of the filaments at the moment of reaching the yarns, but generally, the adhering ability of the filaments of a polymer will decrease approximately inversely proportionally to the increment in tenacity of the ejected filaments of said polymer.

If adhering property of ejected filaments of a warp layer is weak and inconvenience or difficulties occur in the following lamination with a fleece layer, an appropriate adhesive can be applied additionally to the warp layer in order to secure the firm adhesion of the layer to the fleece layer. Namely, there are two kinds of adhesive filaments, although it is the absolutely necessary condition that adhesive filaments should have sufficient adhering ability to the yarns at the moment when said filaments reach said yarns in order to adhere thereto immediately after ejected. The one kind of said filaments is the one which adheres to a fleece layer by their own adhesive ability at the time of lamination and the other is the one assisted by additional adhesives.

To apply additional adhesives is merely an additional procedure well known to those who are skilled in the arts and merely strengthens adhesion of the warp layer to the fleece layer and so it is intended that this procedure be included in the scope of the present invention.

For example, a warp layer which has ejected adhesive filaments of a high melting point and to which an additional adhesive of a lower melting point has been applied, can be laminated easily with a fleece layer under the condition that only the additional adhesive melts and can secure firm adhesion of the warp layer to the fleece layer to attain the purpose of the present invention. Moreover, there are many cases where the kind and the origin of the yarns of a warp layer are different from those of a fleece layer to be combined therewith. Adhesion of the warp layer to the fleece layer is effectively achieved by selecting an appropriate additional adhesive exerting sufficient adhesive power to both of the layers, according to the required properties of the product. When a polyolefin is used as a polymer for adhesive filaments which is to adhere to the arranged yarns composed of stretched products of the same kind of polymer, the low molecular weight ingredient of the adhesive polyolefin will be squeezed out into the skin portion of the filaments, as said ingredient has a lower melting point and solidification is delayed and good adhesion to yarns can be achieved. A warp layer thus obtained will readily adhere to a fleece layer composed of the same kind of polymer, but it is difficult to adhere to a fleece layer of different kind of polymer. In the latter case, an appropriate additional adhesive which has adhering ability to the yarns and to the fleece layer is applied.

For yarns of high density polyethylene, a copolymer of ethylene and vinylacetate or said copolymer blended with paraffin and a modified natural resin in order to form a hotmelt adhesive is used as an adhesive polymer. The adhesive polymer adheres well to commercially available short fibers of a fleece layer and there is no need of applying an additional adhesive. A warp layer, whose adhesive filaments are prepared by ejecting centrifugally a dope of polyvinyl alcohol of high concentration, adheres well to commercially available short fibers of a fleece layer when pressed while heating with moisture.

As commercially available adhesive polymers suitable for adhesive filaments ejected centrifugally, there are thermoplastic polymers, compounded with necessary ingredients, selected from the polymer group consisting of polyolefin, polyvinyl chloride, polyvinyliden chloride, polyvinyl alcohol, polyamides, polyesters, polyacrylics, polystyrene and polyurethanes including copolymers of the polymers above-mentioned, and thermosetting polymers in the initial state of polymerization or condensation which still have spinnability into filaments. These thermosetting polymers in this state are cured at the time of lamination or after lamination and are so-called pre-polymer such as those of phenolics, epoxys, heat-curable acrylics, urethanes, allyl-esters and those formed from urea and melamine.

Moreover, there are often cases where adhesive polymers other than above-mentioned must be selected in accordance with the necessary properties required in the application field of the non-woven product to be prepared.

Colored adhesive polymer can be used for adhesive filaments. These filaments will give a colored stripped pattern on the surface of the non-woven product of the present invention and especially when a fleece layer applied is white, a beautiful stripped pattern appears.

As for fleece layers, paper and non-woven fabric can be laminated with a warp layer, as it is in the state available from market, as explained thereinbefore but there are many kinds of short fibers which are available in bulk or in the form of extremely thick laps, but not in the shape of fleece layers suitable for the raw materials applicable to the method of the present invention. A fleece layer of such kinds of short fibers can be obtained in a state overlaid on a warp layer easily whether in a thin or thick layer at will by a method hereinunder explained.

The method comprises picking up fibers above-mentioned on a warp layer as a fleece layer by filtering the air bearing numberless short fibers floating therein and supplied from a device, such as a willowing machine, or a beating machine which makes the short fibers float in the air, while said warp layer running as a filter medium over a stationary suction zone provided under the warp layer to effect a negative pressure from the backside thereof at the time of filtering.

The weight of short fibers loaded on a unit area of the warp layer as a fleece layer, can be easily controlled by selecting the quantity of short fibers supplied per unit time for filtering and the running speed of the warp layer. By this method, a fleece layer of from less than 10 g up to 100 g or more can be loaded on one square meter of a warp layer.

Similarly, by wet method a fleece layer can be loaded on a warp layer. For example, when a warp layer is overlaid on the screen of a paper-making machine and made to run together with the screen, short fibers such as wood pulp fiber can be picked up as a fleece layer on the warp layer.

Those fleece layer thus picked up and loaded on warp layers can be laminated into non-woven products of the present invention by only pressing while heating. The products thus obtained can not only be used, as they are, in many application fields as non-woven products reinforced longitudinally, but also used as raw materials for further lamination.

Further, as an alternative method for preparing a non-woven product reinforced crosswise, a fleece layer is placed on a weft layer in place of a warp layer and made said fleece layer adhere to the weft layer and then a warp layer is place again onto the product thus obtained in a manner as stated before and said warp layer is made adhere thereto.

A weft layer laminated with a fleece layer is an intermediate product but has a merit that the product is reinforced mainly in the lateral direction thereof and there are cases where such reinforcing is required.

Next, descriptions about adhesive filaments will be given. The thickness and arrangement of the filaments should be changed according to the thickness and other properties of a fleece layer applied. In case where pitches of adhesive filaments are 1–2 mm, even very short fibers constituting a paper can be joined together into lines composed thereof, at the parts where said filaments have been allocated on the paper surface, resulting in serving to keep strength as a paper even when wetted with water, and at the same time to keep air permeability without completely losing though somewhat reduction occurs. Paper thus reinforced to have a high strength in the longitudinal direction is slit into tapes or bands and if more strength in longitudinal direction is necessary, several sheets of papers are piled up alternately with inserted warp layers, laminated into a thick sheet and slit. These tapes and bands are strong in the longitudinal direction thereof and moreover are pliable and have some degree of water proofness as above-mentioned and can be used for packaging uses.

In case a fleece layer is thicker, permeation of the molten adhesive filaments of a warp layer laminated thereto, would be insufficient towards the thickness direction of the fleece layer, unless the thickness of the adhesive filaments is increased, when pressed while heating. In such cases, it is preferable to apply a warp layer which has thicker denier adhesive filaments adhering crosswise at 5–20 mm pitches to the yarns of said warp layer and also has several number of thinner denier ones between the neighbouring two thicker denier filaments so as to adhere crosswise to the yarns of the warp layer in parallel.

When a fleece layer composed of short fibers, such as staple or cut fibers, or waste fibers and reclaimed fibers containing considerable percentages of comparatively long short fibers, is combined with a warp layer, having adhesive filaments of thicker denier adhering to the yarns thereof at pitches of 5–20 mm those short fibers can be sufficiently joined together by said thick filaments resulting in the formation of reinforcement parallel lines at parts where said adhesive filaments have been allocated. The product is particularly pliable and air permeable and has a certain degree of strength sufficient to exhibit considerable degree of dimensional stability in the lateral direction.

This type of a warp layer can easily be prepared by the method of prior invention of two inventors of the present application and three other inventors already cited before with a small modification, in which method, among small orifices furnished around the outer periphery of the high speed rotating vessel of discus shape, orifices having a larger diameter than said orifices are disposed at definite pitches. The thicker denier adhesive filaments on a warp layer thus obtained can penetrate well through the thickness direction of a thick fleece layer laminated therewith to secure firm adhesion of the fleece layer through the whole thickness thereof at parts where said thick adhesive filaments have been allocated and the thinner denier adhesive filaments fix the short fibers only on the surface of the fleece layer, preventing said short fiber ends from fluffing out of the surface. This method is preferably applied to the case where a fleece layer having a thickness of 50–100 g per square meter thereof is to be combined with a warp layer with so small a quantity of adhesive filaments as that of 15–25 g per square meter thereof, to provide a well fixed non-woven product having sufficient strength, air-permeability and pliability.

Stretched products of polyolefins, such as stretched tapes or flat yarns are cheaper comparing to their strength and thus abundantly produced. Flat yarns have a merit among others in their large covering power over a fleece layer applied, when used as yarns for a warp layer. A warp layer of flat yarns has two different surfaces, that is, the one surface has adhesive filaments thereon and the other none and when laminated with a fleece layer, the surfaces having adhesive filaments thereon should be faced towards the fleece layer.

However, when split fiber yarns having reticulated structure of fine fibers, prepared by splitting the same flat yarns, are used as yarns for a warp layer, the warp layer thus made of split fiber yarns can be sandwiched between two fleece layers or several fleece layers can be alternately piled up with inserted warp layers of split fiber yarns and laminated into a thick product. Adhesion of each warp layer to the facing surfaces of the fleece layers in this case is sufficiently secured, owing to the fact that when pressed while heating, adhesive filaments adhering to one surface of the warp layer permeate well through the split gaps of the yarn to the other surface thereof to effect sufficient adhesion there. This fact is by no means expected in case of warp layer made of only flat yarns and is an advantage of the use of split fiber yarns.

The non-woven products obtained according to the method of the present invention can be applied to many application fields, because the products suitable for desired specific usages can be prepared by selecting the structure of the product to be prepared and also selecting the most suitable raw materials, that is, yarns and adhesive polymer for warp layers, and short fibers for fleece layers for said specific usages from among wide variety of raw materials available from market.

Short fibers, which cooperate with a less amount of yarns together with adhesive filaments in giving a more tenacious properties to the non-woven product especially in case reinforced crosswise are cheaper as compared with the yarns of the same origin, even if said short fibers are staple or cut fibers; this means that the raw materials composing the products are cheaper than those of the woven textile of the same density, needless to say of the case in which extremely cheap waste fibers or reclaimed fibers are used. However, a conventional non-woven fabric or matt available from market can be used as a fleece layer, though expensive, in the present invention, but the product becomes dimensionally more stable and the application field thereof can be widened.

The non-woven product reinforced longitudinally can be used not only for packaging as tapes, bands, etc., but also for insulation purposes against heat conduction. Moreover, when laminated with film form materials or coated with suitable coating agents, the product can be used as wrapping materials for corrosion-proof or water-proof purposes or for preventing wrapped articles from being injured, and further, when laminated again with other materials such as paper, film, etc. a longitudinally reinforced product of said other material is obtained.

In most of the re-lamination procedures, there are many cases where additional adhesives are not necessary. In these cases adhesive filaments or a warp layer applied can serve as adhesive filaments for fixing the arrangement of the warp layer in the first place, as wefts of a filter medium for picking up short fibers for a fleece layer while cooperating with yarns as warps in the second place, as an adhesive polymer for fixing the short fibers of a fleece layer after laminated with a warp layer in the third place, as an adhesive for laminating the product again with other materials in the fourth place, and also play a function of fluff prevention on the exposed surface of the product in the fifth place. The same functions of adhesive filaments are seen in case of non-woven products reinforced crosswise. From these points of view, the adhesive filaments are playing a quintuple role.

The product reinforced crosswise are applicable not only to the same field as those of the product reinforced longitudinally thereinbefore stated, though expensive, but also to many application fields in which the products display fully their characteristic properties.

The product reinforced crosswise, as they are, are applicable to wrappings in packaging field, a raw material for making bags for crops, feed stuffs for domestic animals or fowls and other miscellaneous articles, because of their strength, especially their seam strength when sewn up and air permeability thereof; when laminated again with a film, the product is applicable to water-proof or moisture-proof wrapping materials, covering sheets and bags for fertilizers or chemicals; with or without further lamination with a film, a product suitable for agricultural application fields, such as matt substitute, sun-shade, etc. can be obtained.

The products reinforced crosswise applicable to those mentioned above are mainly prepared by using polyolefin stretched products, such as stretched tapes and split fiber yarns, and fleece layer composed of reclaimed fibers or waste fibers, because of their cheapness as compared with their strength.

For reinforcing construction materials, such as boards, products of glass fiber yarns and fleece layer composed of cut fiber glass, glass-wool are used, because of their higher tenacity, small elongation and fireproofness together with their inertness to moisture, etc.

For so-called F R P (Fiber Reinforced Plastics), together with glass fiber yarns and a fleece layer of cut fiber glass or glass-wool, especially selected kind of adhesive filaments is used according to the kind of matrix polymers to be applied and for fire-proofness, self-extinguishing adhesive filaments are applied.

For civil engineering application fields, such as sheets for covering watery mud and materials for drainaging devices in case of reclamation works of ponds or foreshores, the property against the corrosive nature of soil and mud is essential and the raw materials of the products for this kind of application field must be selected from those made of artificial polymers, for instance, for yarns, products of polyolefin are selected and for fleece layers, reclaimed fibers such as reclaimed nylon fibers from waste tire are selected.

Further, noteworthy usages of the non-woven products reinforced crosswise are those for carpet backings and scrims for carpets, especially for needle-punched carpets. For this kind of usage, preferable yarns are spun yarns of cotton, regenerated cellulose fibers, vinylon fibers or those fibers of the same as those of surface fibers to be needle-punched and short fibers for fleece layers must be those of the same fibers as of the surface fibers, for avoiding contamination of the surface of needle-punched products by the short fibers contained in the scrims which are apt to be protruded out to appear on the surface of the products at the time of needle punching. After needle punched, heat pressing of the products results in fixation of the needle-punched surface fibers at points contacting with the scrim by the adhesive polymer already applied there as adhesive filaments without fear of falling off of the surface fibers needle punched. For piled carpets, a fleece layer of jute short fibers is preferable.

As above-mentioned, according to the method of the present invention, products being not at all inferior to conventional woven or knitted ones can be prepared for industrial application fields. Fibers incapable of weaving or knitting because of their brittleness, such as carbon fibers and alkali-proof glass fibers can be converted into non-woven products, usable as in case of woven or knitted products, according to the method of the present invention and said products will be able to display their respective characteristic properties fully in the expected usage thereof.

BRIEF DESCRIPTION OF THE DRAWINGS

FIGS. 1 and 2 show schematic patterns of typical warp layer.

FIG. 2 shows a part of a warp layer having thick and thin adhesive filaments.

FIGS. 3*a*, 3*b*, 3*c* and 3*d* show schematically that a warp layer (FIG. 3*a*) is laminated with a fleece layer (FIG. 3*b*) into a non-woven product reinforced longitudinally by warp yarns as well as transversely by lines of adhesive polymer (FIG. 3*c*). FIG. 3*d* shows schematically an enlarged bird's eye view of a corner (P) of the product.

FIGS. 4*a*, 4*b*, 4*c*, 4*d*, 4*e* and 4*f* show schematically that a warp layer (FIG. 4*a*) and another warp layer used in the weft direction (FIG. 4*c*) are laminated with a fleece layer (FIG. 4*b*) into a non-woven product reinforced cross-wise in a manner that the aligned yarns (FIG. 4*d*, 1) on the upper surface of the product are laid crosswise to the aligned yarns (FIG. 4*d* 1') on the lower surface, while the fleece layer is sandwiched between the upper and lower sides warp layers. FIG. 4*e* shows schematically the bird's eye view of a corner (Q) of the product from above and FIG. 4*f* shows schematically another bird's eye view of said corner of the product from below.

FIG. 5 shows schematically how thick adhesive filaments of a warp layer premeates vertically through the fleece layer where a warp layer having thick and thin adhesive filaments is employed.

DETAILED DESCRIPTION OF THE DRAWINGS

In FIG. 1, yarns 1 arranged in parallel at definite pitches are fixed in the arrangement thereof by a number of adhesive filaments 2 adhering in parallel to one surface of the aligned yarns 1 and laterally connecting the yarns 1 one-by-one with said adhesive filaments 2.

FIG. 2 shows a warp layer similar to the one shown in FIG. 1, but having two kinds of adhesive filaments, that is, thick ones 2' and thin ones 2''. Said adhesive filaments are disposed in a manner that a certain number of thin ones (2'') are disposed between the adjacent two of the thick ones (2').

In FIGS. 3*a*, 3*b*, 3*c* and 3*d*, a warp layer, having yarns 1 in alignment at definite pitches and adhesive filaments 2 adhering crosswise to said yarns, as shown in FIG. 1, is laminated with a fleece layer 4 into a non-woven product reinforced longitudinally by warp yarns as well as transversally by lines of adhesive polymer (FIG. 3*c*) having longitudinally reinforcing yarns 1 adhering longitudinally to one surface of the fleece layer and at the same time, a transversally reinforcing number of lines 3 of solidified adhesive polymer originating from adhesive filaments 2 in FIG. 3*a*, together with short fibers of the fleece layer 4 in FIGS. 3*c* and 3*d*.

FIG. 3*d* shows schematically the structure of the product, in which aligned yarns 1 adhering to one surface of the fleece layer 4 and a number of lines 3, explained above, of solidifed adhesive polymer together with short fibers of a fleece layer 4 joined therein after said adhesive polymer has permeated vertically into the fleece layer depending upon the thickness of said adhesive polymer.

In FIGS. 4*a*, 4*b*, 4*c*, 4*d*, 4*e* and 4*f*, a warp layer (FIG. 4*a*) having aligned yarns 1 at definite pitches and adhesive filaments 2 adhering crosswise, as shown in FIGS. 1 and 2, and another warp layer (FIG. 4*c*) of the similar structure thereto are laminated with a fleece layer 4 in a manner that the aligned yarns 1 on the upper surface of the product are laid crosswise to the aligned yarns 1' on the lower surface of the product into a non-woven product (FIG. 4*d*) reinforced crosswise, while the fleece layer 4 is sandwiched between the upper and lower warp layers.

FIG. 4*e* and FIG. 4*f* are fragmentary perspective views of a corner (Q) of the product from above and below, respectively, in which aligned yarns 1 and aligned adhesive filaments 3 are on the upper surface of fleece layer 4 and aligned yarns 1' and adhesive filaments 3' are on the lower surface of the fleece layer 4. FIGS. 4*e* and 4*f* also both show the structure of the non-woven product reinforced crosswise in which the groups of aligned yarns 1 adhering to the upper surface of the product are laid crosswise to the yarns 1' adhering to the lower surface of the product, while sandwiching the fleece layer therebetween.

In FIG. 5, lines 3'' are the lines of the thick adhesive filaments (similar to the filaments 2' in FIG. 2) which have permeated vertically through fleece layer 4, and lines 3''' are the thin adhesive filaments (corresponding to the thin adhesive filaments 2'' in FIG. 2) which have also permeated vertically through fleece layer 4.

Then, as stated above, the non-woven products prepared according to the present invention, reinforced whether longitudinally or crosswise, have respective advantage in the various respective application field.

The following examples illustrate the method of the present invention for easy understanding but are not intended to limit the invention described herein.

EXAMPLE 1

Flat yarn of 1,000 denier made of high density polyethylene were split into split fiber yarns of reticulated structure and arranged into a cylindrical form of 1 m in diameter at pitches of 10 mm and made to run downwards at a speed of 50 m per minute in the direction along the center line of the cylindrical form. From a high speed rotating vessel of discus shape, positioned at a central part of said cylindrical form and having 50 orifices on the outer periphery of said vessel, composed of 5 groups, each of which consisted of one large orifice and 9 small orifices arranged in the same order, filaments of an adhesive polymer of hot-melt type were ejected by centrifugal force onto the inner side of the cylindrically arranged split fiber yarns. The thicker denier filaments of the adhesive polymer of 800–1,000 denier were made adhered crosswise to the yarns at 10 mm pitches, and between them, there were thinner denier filments of 25–50 denier adhering crosswise at 1 mm pitches to the yarns. Thus a warp layer composed of split fiber yarns as warps and a number of adhesive filaments adhering crosswise to the yarns on one surface of the layer as wefts were obtained at the speed of 50 m per minute, after cutting open and flattened. The warp layer was composed of 11 g of split fiber yarns and 14–16 g of adhesive filaments per square meter thereof and adhering pitches of the filaments were 1 mm.

The warp layer thus obtained was inserted between two sheets of kraft paper of 70 g per square meter thereof and the whole was pressed under heating. The thicker denier adhesive filaments penetrated nearly through the thickness direction of the paper on both surfaces of the warp layer at intervals of about 10 mm and completely fixed the three layers composed of the warp layer and two sheets of the paper covering on both the surface of the warp layer and the thinner denier adhesive filaments made split fiber yarns firmly adhere to each facing surface of the paper by penetrating through the split gaps of the yarns.

The product thus reinforced in the longitudinal direction by split fiber yarns and in the lateral direction by a number of lines composed of connected short paper fibers with adhesive filaments at 1 mm pitches was obtained and the product had a certain extent of resistance to degrading by water wetting.

The product, as it was in wide width, was suitable for a wrapping material in packaging usages and, when slit and wound into rolls of strips 100–150 mm wide, the rolls of said strip were suitable for puttee-like wrapping of coiled winding of metal wire into a dough-nut shape.

EXAMPLE 2

A warp layer, obtained by the same method as explained in Example 1 were used as a filter medium and waste jute fibers, which had been willowed and disintegrated into comparatively fine fibers and sent in a state floating in the air, were picked up on said warp layer at a rate of 100 g of fibers per square meter of the warp layer. Onto the picked up waste jute fiber layer, another warp layer of the same structure was overlaid, facing the adhesive filaments stuck thereto towards the jute fiber layer and the whole was pressed while heating to prepare a non-woven product. The product thus obtained was reinforced longitudinally by parallel split fiber yarns sticking to both the surface of the product and fluffings on both the surfaces were prevented by adhering adhesive filaments, by which comparatively long waste jute fibers were joined together at parts where said filaments had been allocated so as to form a number of cooperating reinforcing lines in the lateral direction of the product, causing increase in the lateral strength of the product. The product was more bulky than the product of Example 1 and applicable as a substitute for a woven matt in agricultural usages.

EXAMPLE 3

High density polyethylene flat yarns, 7 mm wide, 0.015–0.02 mm thick and of about 1,000 denier thickness, were arranged at pitches of 10 mm to form a cylinder of 1 m in diameter and made to run downwards in parallel to the axis of the cylinder. While running, a hot-melt type adhesive polymer composed of ethylene-vinylacetate copolymer was ejected onto the inner surface of said cylinder in a form of a number of filaments of 50 denier thickness at pitches of 2 mm by the similar method to that explained in Example 1 to obtain a warp layer.

A fleece layer composed of waste fiber from spinning mills were picked up on said warp layer, as a filter medium, at a rate of 50 g per square meter of the warp layer from the air bearing waste fibers floating therein and sent from a willowing machine which had made said fibers afloat. Upon the waste fiber layer thus picked up on the warp layer, another warp layer of the same structure was overlaid longitudinally, facing the adhesive filaments thereof towards the waste fiber layer and the whole was made to run over heating drums one by one and then pressed to form a laminated product, which was covered on both the surfaces of the fleece layer by flat yarns arranged in parallel in the longitudinal direction thereof together with a number of adhesive filaments adhering crosswise to said yarns and joining the waste fibers together into laterally reinforcing lines, resulting in effective prevention of fluffing out of short waste fibers from both the surfaces.

The product had a certain degree of strength in lateral direction and was suitable for a substitute for a wrapping cloth in packaging fields.

EXAMPLE 4

Glass fiber yarns of 300 denier thickness were arranged at pitches of 1.5 mm and processed into a warp layer, according to the method similar to that explained in Example 1 to have ejected hot-melt type adhesive filaments of 20 denier thickness at pitches of 2 mm. The warp layer thus obtained was used as a substitute for victoria lawn for wrapping rock-wool matt and the wrapped rock-wool matt was so heated as to adhere the warp layer to the surface of the matt. The product was reinforced in the longitudinal direction by glass fiber yarns and had a certain degree of dimensional stability in the lateral direction thereof by joined rock-wool fibers with adhesive filaments adhering crosswise to the yarns at parts where said filaments had been allocated on the surface of the matt, resulting in a product easy to handle without prickling.

The warp layer of glass fiber yarns mentioned above is cheaper as compared with woven stuffs of the same glass fiber yarns, which is fire-proof but, as a hot-melt type adhesive polymer used in the Example 4 is in general combustible, phenolic type adhesive polymer which is self-extinguishing is more preferable in this case, considering the fact that bonding agent of rock-wool matt is usually of phenolic type.

EXAMPLE 5

Glass fiber yarns of 600 denier thickness were arranged in parallel at pitches of 5 mm to form a cylinder of 1 mm in diameter and made to run longitudinally along the center line of said cylinder and made into a warp layer having adhering adhesive filaments of 50 denier thickness at pitches of 1 mm thereto, according to a similar method to that explained in Example 1.

Upon the warp layer thus obtained, cut short glass fibers were picked up as a fleece layer at a rate of 30 g per square meter of the layer from the air bearing said cut short glass fibers floating therein, according to the same method as explained in Example 3 and the whole was pressed while heating to adhere the fleece layer to the warp layer. According to the modified method described in U.S. Pat. No. 3,859,156, already cited thereinbefore, the product obtained as above-mentioned, was fed as a warp web and another warp layer of the same structure was fed as wefts, in a manner where the surface of cut sheets of said warp layer for wefts having adhesive filaments thereon were made faced towards the fleece layer on the warp web at the time of dropping. Then the whole was pressed while heating again to form a non-woven product reinforced crosswise, having longitudinal sticking fiber glass yarns arranged in parallel in one surface thereof and laterally sticking fiber glass yarns arranged in parallel on the other surface thereof. The product was composed of 26 g of fiber glass yarns, 30 g of cut glass fibers and about 8 g of adhesive polymer per square meter of the product. Textures of the yarns on both warp and weft directions of the product would not become disordered at the time of handling due to the insertions of cut fiber glass layer between warp and weft layers of yarns of parallel arrangement and the strength in the direction at an angle of 45° with warp or weft yarns was 2.2 kg per 50 mm width of the product, as compared with that of 1.2 kg per 50 mm width in case without inserted cut fiber glass layer. The products were suitable for scrims for asphalt immersed water-proof sheets or those for reinforcing construction materials such as boards.

Alternatively, the similar product to that obtained in Example 5 is prepared by a method explained hereinunder, namely by overlaying longitudinally a weft layer prepared in advance onto the cut short fiber glass layer, which has been picked up as a fleece layer on a warp layer and made adhere thereto, according to the same method explained in Example 5 and pressing the whole again while on heating. Example 6 will illustrate one embodiment of the preparation manner of the product stated above.

EXAMPLE 6

Glass fiber yarns of 600 denier thickness were arranged in parallel at 5 mm pitches to form a cylinder of 1 mm in diameter and processed into a warp layer and a fleece layer of 30 g per square meter of cut short fibers were picked upon said warp layer and made adhere to said warp layer according to the same method described in Example 5 to prepare a web for warp side.

According to a modified method of U.S. Pat. No. 3,859,156, another warp layer obtained as above-mentioned was fed as a web for wefts onto a lattice belt conveyer circulating crosswise to and above a circulating belt means composed of 9 narrow belts of 10 mm in width arranged in parallel at 125 mm pitches. A selvedge material composed of 5 ends of 600 denier glass fiber yarns was supplied, respectively along each of the courses 20 mm apart from the outer edges of said belt means in the upper circulation route thereof and caused to run at the same speed and direction as those of said belt means side by side.

The warp layer for wefts fed onto the lattice belt conveyer, was made adhere to said conveyer by a surface tension of water wetting the surfaces of lattices of said conveyer and in the upper circulation route thereof, said warp layer was cut into cut sheets successively by a length sufficient to cover the distance between right and left side selvedge materials with a certain surplus length at the front and rear cut ends of the cut sheets, respectively by pressing a knife edge upon the layer while passing over definite lattices of the conveyer.

The cut sheets were conveyed into the lower circulation route of the conveyer one after another while adhering thereto and were dropped crosswise upon the circulating belt means, accompanied by the selvedge material on each of the right and left edges thereof, one by one without leaving any gaps between each other at the moment when each of said cut sheets comes to a position wholly covering said belt means with accompanying selvedge materials and the front and rear cut end parts of the cut sheets were able to be placed on the respective right and left selvedge materials. Then the said cut end parts of the sheets were made adhere to the respective selvedge materials.

In this case, it was preparable that additional 9 ends of glass fiber yarn of 600 denier were made adhere to the surface of the weft layer other than the surfaces bound to face the fleece layer in parallel at 100 mm pitches between both of the selvedge materials for easy lamination with the web for warp side and withdrawn.

The web for warp side already obtained was fed onto the running weft layer thus obtained so as to be overlapped longitudinally on said weft layer, while facing the fleece layer towards the surface of said weft layer without having additional yarns adhering thereto and the whole was pressed under heating and taken up after trimming both of the selvedge materials. Then a non-woven product reinforced crosswise, similar to that obtained in Example 5, was formed.

What is claimed is:

1. A non-woven product comprising (a) a fleece layer of short fibers in random arrangement, (b) one surface of said fleece layer having affixed thereto a plurality of elongated yarn members that are spaced apart from each other at regular intervals in generally parallel rows, all of said yarn members extending only in a longitudinal direction with respect to said fleece layer, and (c) said surface of said fleece layer containing a plurality of essentially continuous lines of joined short fibers of the fleece layer by heat meltable adhesive material almost entirely penetrating down into the fleece layer, said adhesive lines being disposed generally parallel to each other and transversely with respect to said plurality of yarn members, said adhesive lines consisting of thicker lines which are composed of joined short fibers of the fleece layer by adhesive material that has penetrated almost entirely through the fleece layer in the thickness direction and at least one thinner line disposed between every adjacent pair of said thicker adhesive lines, said thinner lines being composed of short fibers of the fleece layer joined by adhesive material penetrating into said fleece layer a lesser distance than that of said thicker lines.

2. A non-woven product comprising (a) a fleece layer of short fibers in random arrangement, (b) one surface of said fleece layer having affixed thereto a plurality of elongated yarn members that are spaced apart from each other at regular intervals in generally parallel rows, all of said yarn members extending only in a longitudinal direction with respect to said fleece layer, (c) said one surface of said fleece layer containing a plurality of essentially continuous lines of joined short fibers of the fleece layer by heat meltable adhesive material almost entirely penetrating down into the fleece layer, said lines being disposed generally parallel to each other and only transversely with respect to said plurality of yarn members, said lines consisting of thicker adhesive lines which are composed of joined short fibers of the fleece layer by adhesive material that have penetrated almost entirely through the fleece layer in the thickness direction and at least one thinner line disposed between every adjacent pair of said thicker lines, said thinner lines being composed of short fibers of the fleece layer joined by adhesive material penetrating down into said fleece layer a lesser distance than that of said thicker lines, (d) the other surface of said fleece layer having affixed thereto a plurality of elongated yarn members that are spaced apart from each other at regular intervals in generally parallel rows, all of said yarn members extending only in a transverse direction with respect to said fleece layer, and (e) said other surface of said fleece layer containing a plurality of essentially continuous lines of joined short fibers of the fleece layer by heat meltable adhesive material almost entirely penetrating down into the fleece layer, said adhesive lines being disposed generally parallel to each other and only transversely with respect to said plurality of yarn members.

3. The method for producing a non-woven product which comprises:

(a) providing a network composed of (1) a plurality of elongated yarn members disposed in a plane, said yarn members being spaced apart from each other at regular intervals in generally parallel rows in the longitudinal direction of the network, and (2) a plurality of adhesive filaments consisting solely of heat meltable adhesive material in a solid state, said adhesive filaments being disposed generally parallel to each other and transversely to said plurality of yarn members, said arrangement of adhesive filaments including thick adhesive filaments at spaced apart intervals and at least one thin adhesive filament disposed between each sequence of two thick adhesive filaments, (b) providing a fleece layer of short fibers in random arrangement, (c) causing one surface of said fleece layer to adhere to said network by heat pressing the network to cause said adhesive filaments to melt completely and penetrate down into said fleece layer to an extent corresponding to the respective thickness of each of the adhesive filaments, and (d) allowing said penetrated adhesive to set in the fleece layer.

whereby said fleece layer will be reinforced in the longitudinal direction by said yarn members and will be reinforced in the transverse direction only by the plurality of lines of short fibers of the fleece layer joined by adhesive that has melted from said adhesive filaments and penetrated into the fleece layer and set therein.

4. The method for producing a non-woven product which comprises (a) providing a first network composed of (1) a plurality of elongated yarn members disposed in a plane, said yarn members being spaced apart from each other at regular intervals in generally parallel rows in the longitudinal direction of the network, and (2) a plurality of adhesive filaments consisting solely of heat meltable adhesive material in a solid state, said adhesive filaments being disposed generally parallel to each other and transversely to said plurality of yarn members, said arrangement of adhesive filaments includes thick adhesive filaments at spaced apart intervals and at least one thin adhesive filament disposed between each sequence of two thick adhesive filaments, (b) providing a second network similar to said first network, (c) providing a fleece layer of short fibers in random arrangement, (d) arranging said first and second networks so that their yarn members extend at approximately right angles to each other and then interposing the fleece layer therebetween, (e) causing the upper surface of said fleece layer to adhere to said first network and the lower surface of said fleece layer to adhere to said second network by heat pressing the networks to cause said adhesive filaments to melt completely and almost entirely penetrate down into said fleece layer to an extent corresponding to the respective thickness of each of the adhesive filaments to the respective thickness of each of the adhesive filaments, and (f) allowing said penetrated adhesive to set, whereby on one surface of said fleece layer the fleece layer will be reinforced in the longitudinal direction only by the yarn members of said first network and will be reinforced in the transverse direction only by the plurality of lines of joined short fibers of the fleece layer by adhesive from said first network that have, once melted, penetrated into the fleece layer and set therein to join the short fibers there and on the opposite surface of said fleece layer the fleece layer will be reinforced in the longitudinal direction only by the plurality of lines of joined short fibers of the fleece layer by adhesive from said second network that have, once melted, penetrated into the fleece layer and set therein to join the short fibers there and will be reinforced in the transverse direction only by the yarn members of said second network.

* * * * *